US011407145B2

(12) United States Patent
Lash et al.

(10) Patent No.: US 11,407,145 B2
(45) Date of Patent: Aug. 9, 2022

(54) GYPSUM SLURRY MIXER OUTPUT CANISTER

(71) Applicant: UNITED STATES GYPSUM COMPANY, Chicago, IL (US)

(72) Inventors: Jason Lash, Valparaiso, IN (US); Michael Krell, New Columbia, PA (US); Leslie Eversole, Milton, PA (US); Domingo Rosario, Elysburg, PA (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 17/024,877

(22) Filed: Sep. 18, 2020

(65) Prior Publication Data

US 2021/0122084 A1 Apr. 29, 2021

Related U.S. Application Data

(60) Provisional application No. 62/926,734, filed on Oct. 28, 2019.

(51) Int. Cl.

| | |
|---|---|
| ***B01F 5/06*** | (2006.01) |
| ***B28C 5/12*** | (2006.01) |
| ***B28C 5/38*** | (2006.01) |
| ***B01F 25/431*** | (2022.01) |
| ***B01F 25/4314*** | (2022.01) |

(52) U.S. Cl.

CPC ..... *B28C 5/1269* (2013.01); *B01F 25/431* (2022.01); *B01F 25/4314* (2022.01); *B28C 5/386* (2013.01); *B01F 25/431974* (2022.01)

(58) Field of Classification Search

CPC ..... B28C 5/1269; B28C 5/386; B28C 5/02; B28C 5/0881; B28C 5/06; B01F 2005/0639; B01F 3/04446; B01F 5/061; B01F 5/0614; B01F 25/431; B01F 25/4314; B01F 25/431974; B01F 23/235; B28B 19/0092; B28B 17/023

See application file for complete search history.

(56) References Cited

U.S. PATENT DOCUMENTS 2,213,161 A * 8/1940 Ericsson ..... F16J 13/00 220/582
3,043,638 A * 7/1962 Maha ..... F16J 10/02 292/256.6

(Continued)

FOREIGN PATENT DOCUMENTS

WO 2013/183891 A1 12/2013

OTHER PUBLICATIONS

International Search Report and Written Opinion received for PCT/US2020/056878 dated Feb. 11, 2021.

*Primary Examiner* — Charles Cooley
(74) *Attorney, Agent, or Firm* — Greer, Burns & Crain, Ltd; Philip T. Petti; Pradip Sahu

(57) ABSTRACT

A gypsum slurry mixer output canister is provided, including a canister housing having an upper end, an opposite lower end and defining a canister interior, a cover secured to the upper end, a slurry inlet in operational relationship to the upper end, a spiral block associated with the upper end, and having a helical flow surface depending into the interior. A flow distributor is secured to the lower end and is in fluid communication with the interior, and a slurry outlet is defined by the lower canister housing end.

20 Claims, 6 Drawing Sheets

(56) References Cited

U.S. PATENT DOCUMENTS

| | | | | | |
|---|---|---|---|---|---|
| 3,266,657 | A * | 8/1966 | Stachiw | F16J 15/46 | 220/239 |
| 3,385,469 | A * | 5/1968 | Gaines | F16B 31/04 | 220/327 |
| 3,460,710 | A * | 8/1969 | Vogeli | F16J 13/02 | 220/327 |
| 4,253,583 | A * | 3/1981 | Lynch | B65D 45/02 | 215/272 |
| 4,494,666 | A * | 1/1985 | Cooper | F17C 13/123 | 220/327 |
| 4,660,736 | A * | 4/1987 | Mays | B65D 45/02 | 220/327 |
| 4,664,281 | A * | 5/1987 | Falk | H02G 3/088 | 174/50 |
| 5,839,828 | A | 11/1998 | Glanville | | |
| 6,742,922 | B2 * | 6/2004 | Shrader | B01F 7/26 | 366/2 |
| 7,404,917 | B2 | 7/2008 | Gannaway et al. | | |
| 9,221,022 | B2 | 12/2015 | Glanville | | |
| 9,856,168 | B2 * | 1/2018 | Ueno | C04B 11/00 | |
| 2004/0062141 | A1 * | 4/2004 | Shrader | B28C 7/0418 | 366/155.1 |
| 2008/0308083 | A1 | 12/2008 | Wirth et al. | | |
| 2015/0315074 | A1 * | 11/2015 | Ueno | B01F 15/0293 | 366/165.2 |
| 2016/0317983 | A1 * | 11/2016 | Jones | B28C 5/381 | |

* cited by examiner

GYPSUM SLURRY MIXER OUTPUT CANISTER

CROSS REFERENCE TO RELATED APPLICATION

This application claims the benefit of priority from U.S. Provisional Patent Application No. 62/926,734 filed on Oct. 28, 2019, the entire disclosure of which is incorporated herein by reference.

BACKGROUND

This invention relates to improvements to gypsum slurry manufacturing apparatuses, particularly to improved apparatuses for distributing slurry from the slurry mixer to the moving conveyor belt during the production of gypsum wallboard.

The basic technology of gypsum wallboard manufacture is disclosed in U.S. Pat. Nos. 1,500,452; 2,207,339 and 4,009,062, all of which are incorporated by reference. It is well known to produce gypsum products by dispersing calcined gypsum in water to form a slurry, then casting the slurry into a desired shaped mold or onto a surface, and allowing the slurry to set to form hardened gypsum by reaction of the calcined gypsum (calcium sulfate hemihydrate or anhydrite) with the water to form hydrated gypsum (calcium sulfate dihydrate). It is also well known to produce a lightweight gypsum product by mixing an aqueous foam into the slurry to produce air bubbles. This will result in a desired distribution of voids in the set gypsum product if the bubbles do not escape from the slurry before the hardened gypsum forms. The voids lower the density of the final product, which is often referred to as "foamed gypsum."

A gypsum wallboard slurry mixer typically includes a housing defining a mixing chamber with inlets for receiving calcined gypsum, water as well as other additives well known in the art. Included in the mixer is an impeller or other type of agitator configured for agitating the contents to be mixed into a slurry. A discharge gate or extractor controls the flow of slurry from the mixer to the dispensing system. Foam and/or other additives are typically added to the slurry through a foam injection port on an outer side wall of the discharge gate through which aqueous foam or other desired additives, such as retarders, accelerators, dispersants, starch, binders, and strength-enhancing products including polyphosphates, sodium trimetaphosphate and the like, after the slurry has been substantially mixed. Suitable gypsum mixers are described in U.S. Pat. Nos. 5,643,510; 5,683,635; 6,494,609; and 6,874,930, all of which are incorporated by reference.

A common problem in designing gypsum wallboard slurry mixers is that the slurry should be kept moving, and any obstructions to free flow or possible locations for slurry to collect and prematurely set are to be avoided. Such premature setting creates clumps of gypsum which form irregularities in the resulting wallboard panels. One such device designed to prevent premature setting of the slurry is disclosed in U.S. Pat. No. 8,475,762, incorporated by reference. Such a device is referred to as a boot, and maintains slurry flow volume in the mixer while providing a desired distribution pattern. It is known to provide a canister between the mixer and the boot to maintain slurry flow volumes for preventing stagnant flow zones in the flow path from the mixer to the wallboard conveyor line.

In gypsum slurry mixers, conventionally the canister was attached to the front of the mixer, and there was no adjustment to allow for changing volume in the mixer. Problems for system designers include the routing, diameter and connection of various hose lines into the area between the mixer and the boot.

Thus, there is a need for an improved slurry distribution apparatus that maintains slurry flow volume and improves flow characteristics from the mixer to the conveyor line.

SUMMARY

The above-listed need is met or exceeded by the present improved mixer output canister that allows slurry to discharge from the mixer and maintain a level which will shorten the required length of hose and allow for better blending of foam and slurry before transitioning to a boot. The present canister is basically a replacement for the hose-to-boot transition that allows for easier routing of a mixer output discharge hose and improved foam blending with the slurry.

The present mixer canister simplifies slurry distribution. Higher slurry output speed is achieved to improve production results. Included in the present canister is a generally cylindrical housing with a cap, a spiral block secured to, and depending from the cap and defining an inverted helical flow surface. The spiral block is constructed and arranged to create a spiral slurry flow in the canister which has sufficient velocity for preventing premature setting and unwanted clumping. Vertically spaced from the spiral block is a flow distributor that converts the spiral slurry flow to a desired linear flow which is more suitable for direction to the outlet boot, and ultimately for deposition upon the wallboard conveyor line on a sheet of face paper as is well known in the art.

In a preferred embodiment, the canister housing has a height of approximately 8.5 inches and the spiral block has a height of approximately 4.5 inches, thus taking up more than 50% of the height of the housing. Further, the flow distributor has a preferred height of approximately 3 inches, so that a flow chamber defined between the spiral block and the flow distributor has a relatively short height of approximately 1.0 inch. For the purposes of this application, "approximately" refers to ±1 inch in the recited dimensions.

More specifically, a gypsum slurry mixer output canister is provided, including a canister housing having an upper end, an opposite lower end and defining a canister interior, a cover secured to the upper end, a slurry inlet in operational relationship to the upper end, a spiral block associated with the upper end, and having a helical flow surface depending into the interior. A flow distributor is secured to the lower end and is in fluid communication with the interior, and a slurry outlet is defined by the lower canister housing end.

In an embodiment, the upper housing end has a radially extending flange for accommodating mounting of the cover, and the spiral block is fastened to an underside of the cover. Also, the slurry inlet has a non-circular cross-section where the inlet meets the housing, and in a preferred embodiment, the slurry inlet has a rectangular cross-section where the inlet meets the housing.

In an embodiment, the spiral block has a vertical inlet wall in fluid communication with the slurry inlet, and forms an end of the helical flow surface. Preferably, the helical flow surface defines a 360° arc. In an embodiment, the spiral block has a vertical height of approximately 4.5 inches, ±1 inch, and the housing has a vertical height of approximately 8.5 inches±1 inch. Further, it is preferred that the housing has a vertical height of approximately 10.5 inches±1 inch.

In an embodiment, the flow distributor defines an outlet aperture having a plurality of lobes in fluid communication with a central opening. Also, the flow distributor includes a plurality of radially inwardly projecting teeth defining a plurality of lobe-shaped recesses in communication with a central opening. It is preferred that the teeth define a radially inwardly tapered internal geometry such that tips of the teeth form an innermost circumference of the central opening. Also, the flow distributor has a vertical height of approximately 3.0 inches, ±1 inch. In a preferred embodiment, the spiral block takes up approximately 50% of a vertical height of the housing.

In another embodiment, a gypsum slurry mixer output canister, is provided, including a canister housing having an upper end, an opposite lower end and defining a canister interior, a cover secured to the upper end; a slurry inlet secured to the upper end, a spiral block associated with the upper end, and having a helical flow surface depending into the interior. A flow distributor is secured to the lower end and is in fluid communication with the interior. A slurry outlet is defined by the lower canister housing end, and the spiral block has a vertical height taking up approximately 50% of a height of the housing, and the flow distributor has a vertical height of approximately 3 inches.

DETAILED DESCRIPTION

Figure 3:
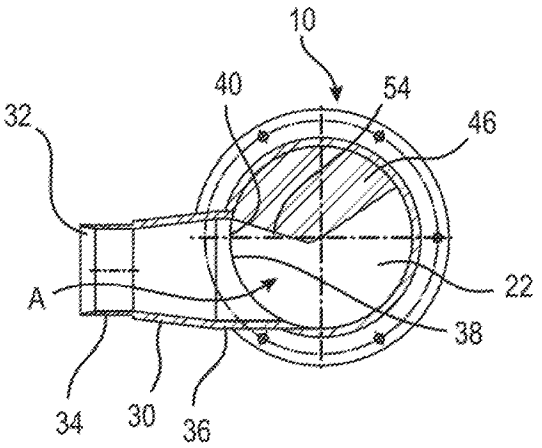
FIG. 3 is a cross-section taken along the line 3-3 of FIG. 2 and in the direction generally indicated.
Figure 2:
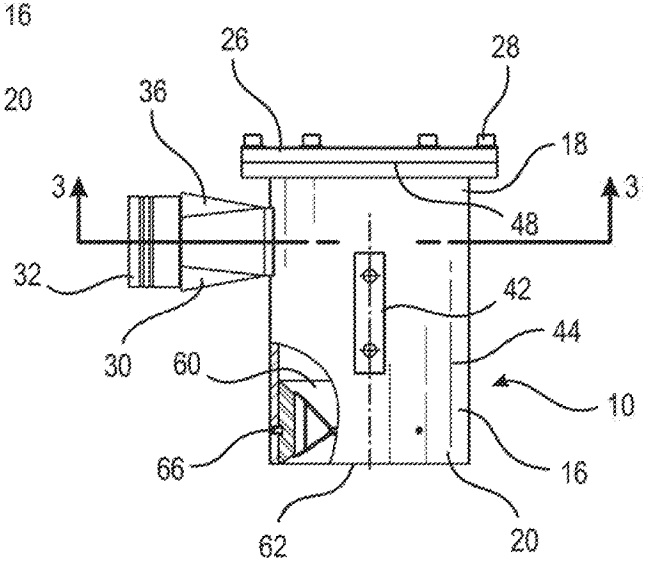
FIG. 2 is a side elevation of the canister of FIG. 1.

Referring now to FIGS. 1-5, a first embodiment of the present slurry mixer output canister is generally designated 10. The canister 10 is constructed and arranged for connection between, and fluid communication with, a mixer output hose 12 and a mixer boot inlet 14. A suitable mixer outlet boot is disclosed in U.S. Pat. No. 8,475,762, which is incorporated by reference. A flow direction of gypsum slurry from the mixer, and intermixed foam, is indicated by arrows 'A'.

Included in the canister 10 is a canister housing 16 which is preferably cylindrical and tubular, however other tubular shapes are contemplated, including but not limited to polygonal. An upper end 18 of the housing 16 is opposite a lower end 20, and a canister interior 22 is defined within the housing. A radially extending flange 24 is preferably provided to the upper end 18 for accommodating secure mounting of a cover 26. Attachment of the cover 26 to the flange 24 is achieved by fasteners 28, preferably threaded bolts or the like as are well known in the art.

Located vertically below the flange 24 is a slurry inlet 30 in operational relationship to the upper end 18 of the canister housing 16. At a free end 32, the slurry inlet 30 has a circular cross-section 34 for connection to the mixer output hose 12. However, as the inlet 30 progresses towards its connection to the canister housing 16, the inlet has a non-circular cross-section 36 where said inlet meets said housing. Also, the inlet 30 has an arcuate edge 38 where the inlet joins the preferably cylindrical canister housing 16. Thus, the inlet 30 is in fluid communication with an aperture 40 in the canister housing 16. In the preferred embodiment, the slurry inlet 30 is secured to the canister housing 16 by welding, fasteners and/or chemical adhesive as is well known in the art. Another feature of the canister housing 16 is at least one mounting bar 42 secured to an exterior 44 of the housing for facilitating the mounting of the canister 10 to corresponding mixer infrastructure (not shown).

Referring now to FIGS. 1, 3, 6 and 7, an important feature of the present canister 10 is a spiral block 46 that depends into the canister interior 22 to create a slurry flow path that follows an interior profile of the housing 16. Also, the spiral block 46, preferably fastened to an underside 48 of the cover 26 by fasteners or the like, fills the canister interior 22 above the aperture 40, or the area between the cover and the aperture. Thus, the presence of the spiral block 46 prevents the unwanted collection of stray slurry that might prematurely set, creating lumps in the resulting wallboard panels.

Figure 1:
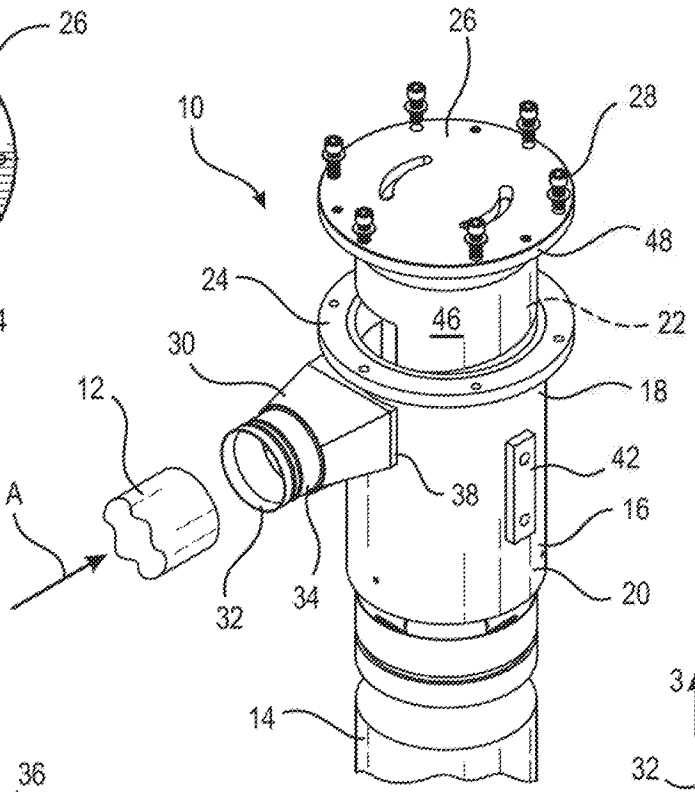
FIG. 1 is an exploded top perspective view of a first embodiment of the present mixer canister.
Figure 4:
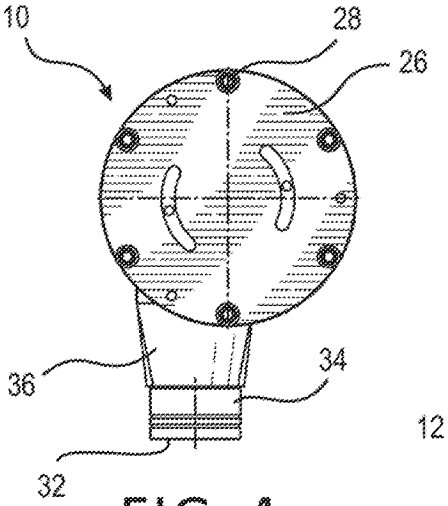
FIG. 4 is a top plan view of the canister of FIG. 1.
Figure 5:
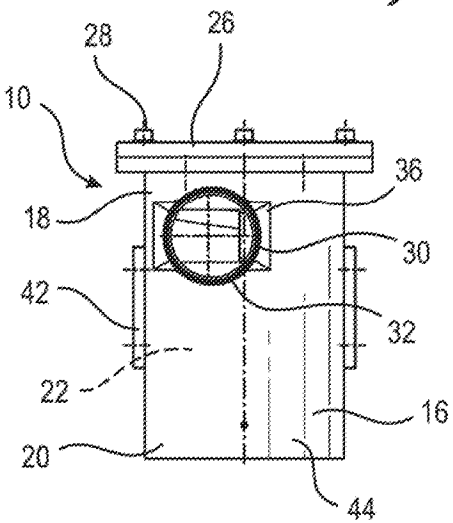
FIG. 5 is a front view of the canister of FIG. 1.
Figure 7:
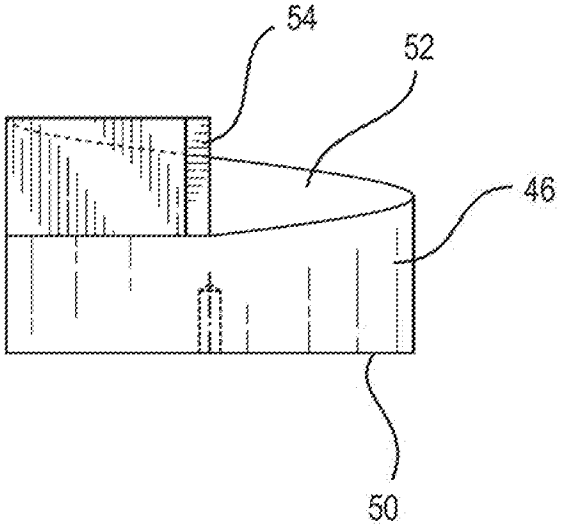
FIG. 7 is a front view of the spiral block of FIG. 6.

More specifically, the spiral block 46 has a generally cylindrical mounting end 50 configured for attachment to the underside 48 of the cover 26. Opposite the mounting end is a helical flow surface 52 that preferably extends a full 360° arc, although with portions of the surface vertically displaced from others. Upon the spiral block 46 being attached to the cover 26 as seen in FIG. 1, the block depends into the canister interior 22.

Figure 6:
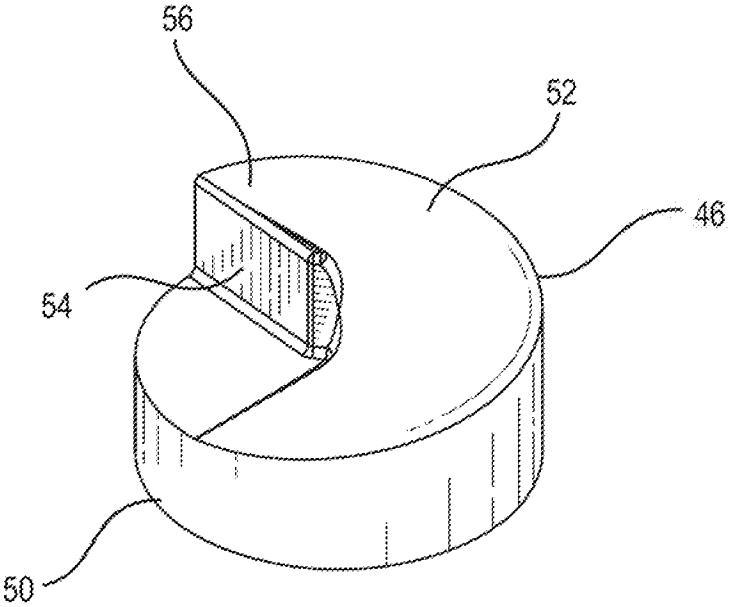
FIG. 6 is an inverted top perspective view of the spiral block of the canister of FIG. 1.
Figure 8:
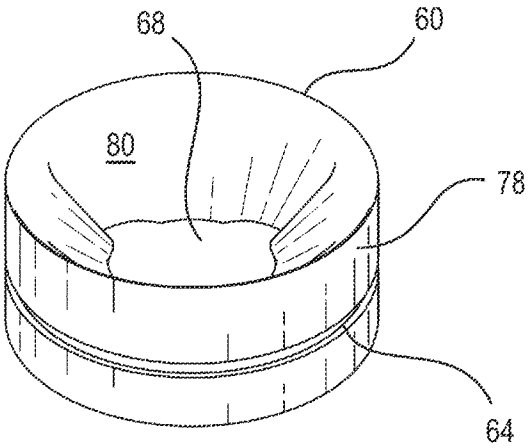
FIG. 8 is a top perspective view of the flow distributor of the canister of FIG. 1.

As seen in FIG. 6, the spiral block 46 has a vertical inlet wall 54 in fluid communication with the slurry inlet 30 and with the housing aperture 40. Also, the inlet wall 54 forms an end of the helical flow surface 52. An upper edge 56 of the wall 54 defines an upper vertical limit of the helical flow surface 52 as seen in FIG. 6, which actually is the lowest limit of the surface once the spiral block 46 is inverted and inserted into the canister interior 22. Also, the vertical inlet wall 54 is aligned with one edge of the aperture 40 (FIG. 3). Incoming slurry passes through the aperture 40, is directed by the vertical inlet wall 54, and begins a circular or spiral flow in the interior 22 due to the configuration of the helical flow surface 52 of the depending spiral block 46.

Referring now to FIGS. 2 and 8-10, another component of the present mixer canister 10 is a flow distributor 60 constructed and arranged to accommodate the generally circular or spiral flow created by the spiral block 46 and reorient the flow to be more linear or laminar. The latter flow is more desirable as the slurry is emitted from the boot and flows upon the moving face paper on the wallboard production conveyor, as is well known in the art.

In the preferred embodiment, the flow distributor 60 is securely located at the lower end 20 of the canister housing 16, and defines a slurry outlet 62. An annular groove 64 on the flow distributor 60 is engaged by at least one fastener 66 such as a set screw (FIG. 2) to secure the flow distributor to the canister housing 16. Also, the flow distributor 60 is in fluid communication with the canister interior 22.

Figure 10:
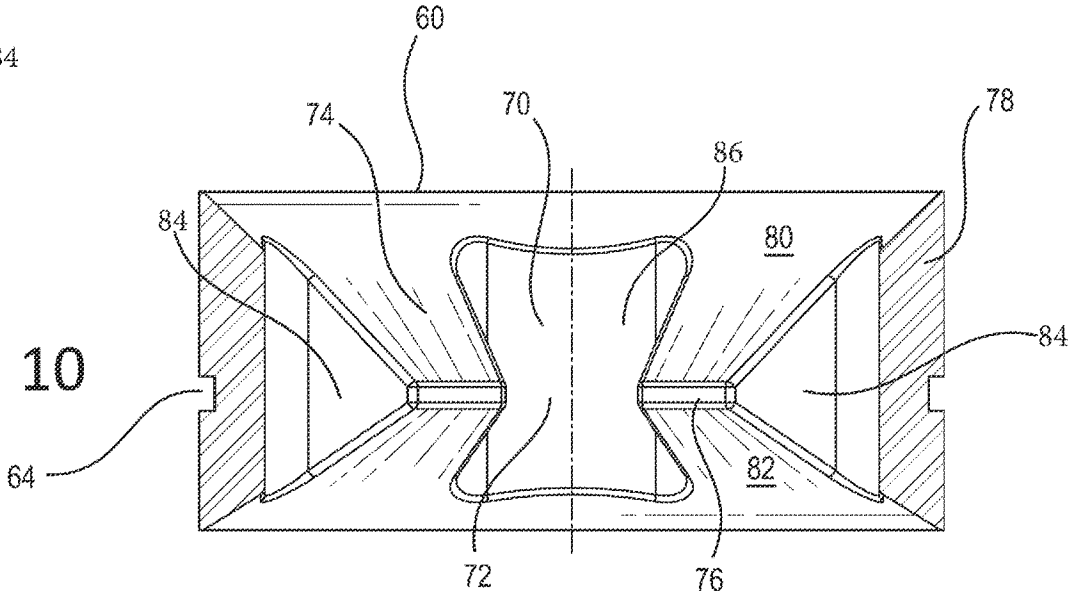
FIG. 10 is a cross-section taken along the line 10-10 of FIG. 9 and in the direction generally indicated.

More specifically, the flow distributor 60 is an integrally formed part, as by machining, casting or the like, and defines an outlet aperture 68 having a plurality of circumferentially arranged lobes 70 in fluid communication with a central opening 72. The lobes 70 are defined by a plurality of radially inwardly projecting teeth 74 (FIG. 9), with each lobe located between two adjacent teeth. Also, the teeth 74 define a radially inwardly tapered internal geometry such that tips 76 of the teeth form an innermost circumference of the central opening 72. As seen in FIG. 10, a wall 78 of the flow distributor 60 defines a generally wedge-shaped cross-section, with the tips 76 of the teeth 74 forming the tip of the wedge. Also, the teeth 74 are formed from upper and lower plate portions 80, 82 that taper towards the tips 76. In the preferred embodiment, the flow distributor 60 has a vertical height defined by the wall 78, and is preferably 3.0 inches tall, ±1 inch.

Figure 9:
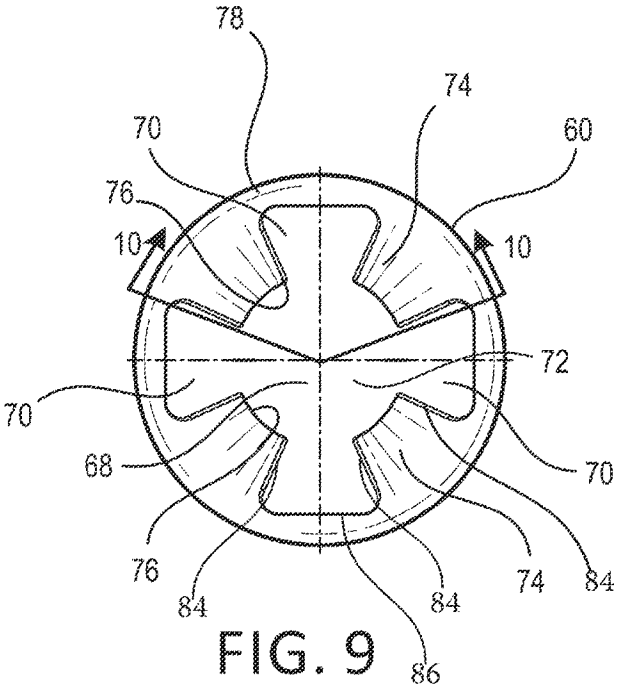
FIG. 9 is a top plan view of the flow distributor of FIG. 8.
Figure 13:
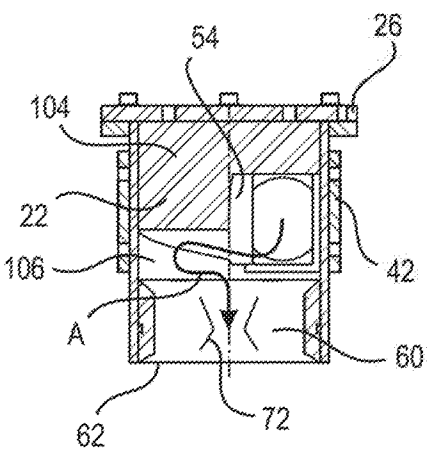
FIG. 13 is a cross-section taken along the line 13-13 of FIG. 12 and in the direction generally indicated.
Figure 14:
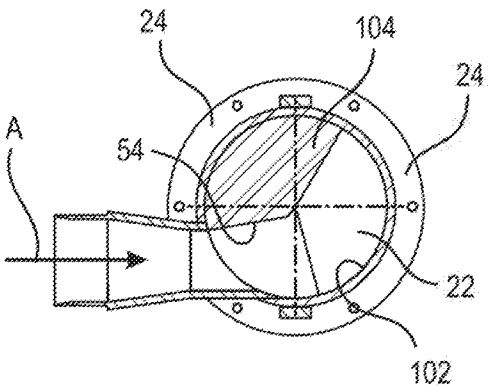
FIG. 14 is a cross-section taken along the line 14-14 of FIG. 12 and in the direction generally indicated.
Figure 11:
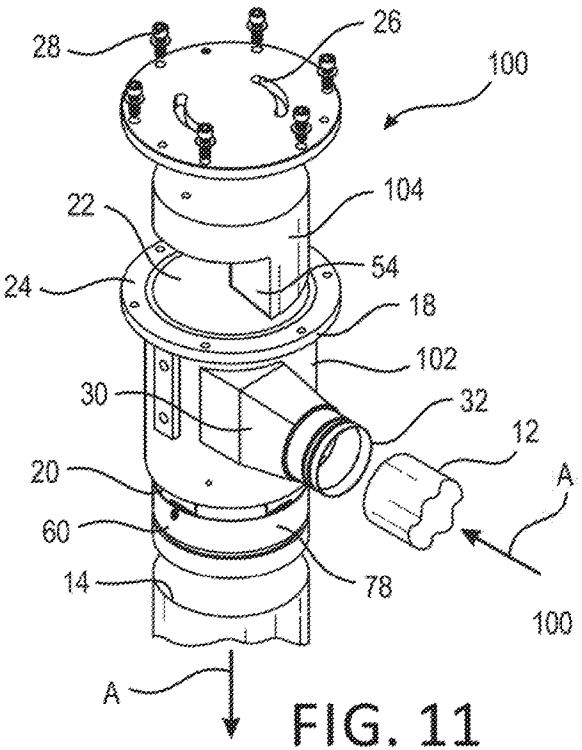
FIG. 11 is an exploded perspective view of another embodiment of the present canister.
Figure 12:
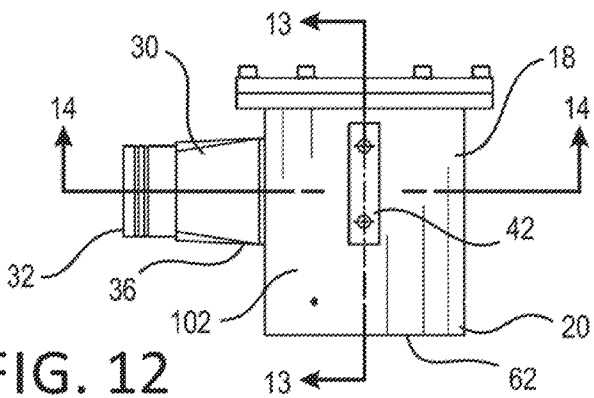
FIG. 12 is a side elevation of the canister of FIG. 11.
Figure 15:
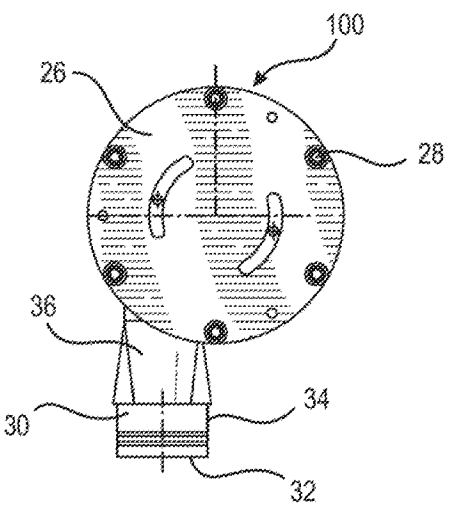
FIG. 15 is a top plan view of the canister of FIG. 11.
Figure 16:
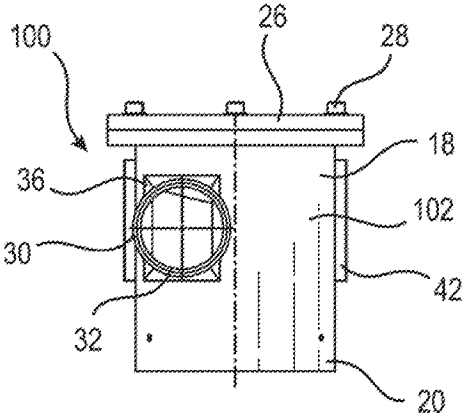
FIG. 16 is a front view of the canister of FIG. 11.
Figure 18:
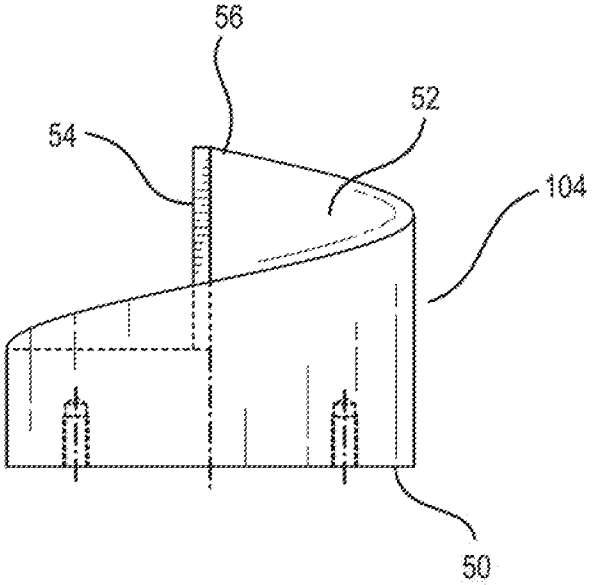
FIG. 18 is a side elevation of the spiral block of FIG. 17.
Figure 17:
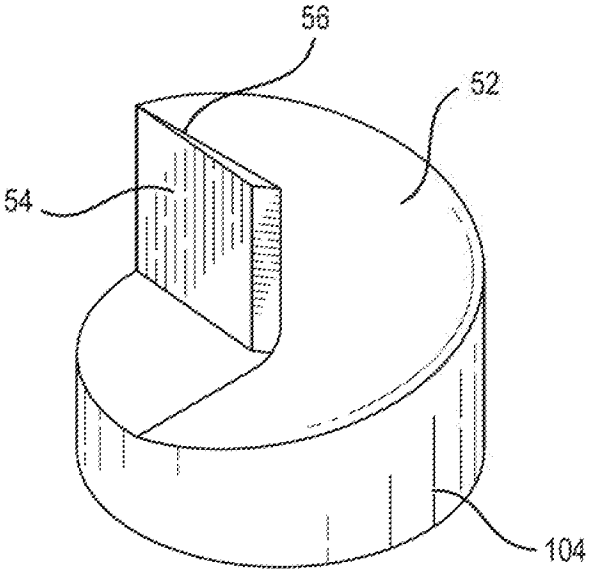
FIG. 17 is an inverted top perspective view of the spiral block of the canister of FIG. 11.
Figure 19:
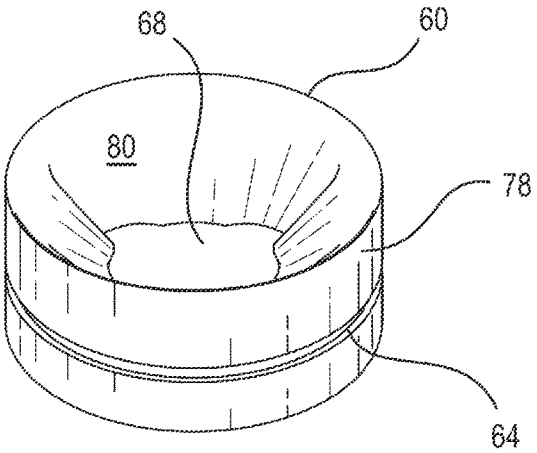
FIG. 19 is a top perspective view of the flow distributor of the canister of FIG. 11.
Figure 21:
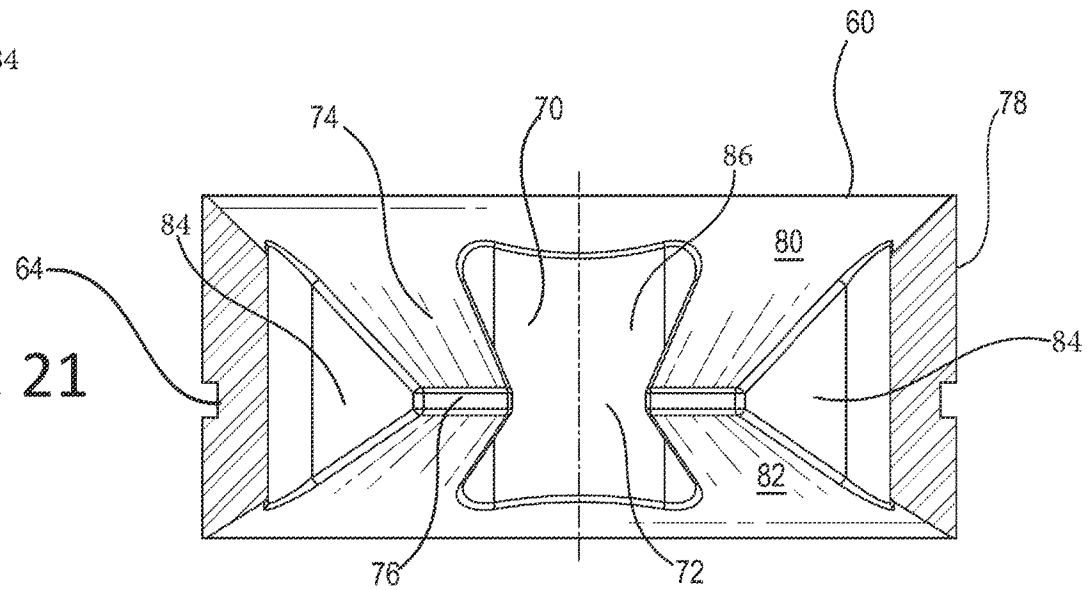
FIG. 21 is a cross-section taken along the line 21-21 of FIG. 20 and in the direction generally indicated.
Figure 20:
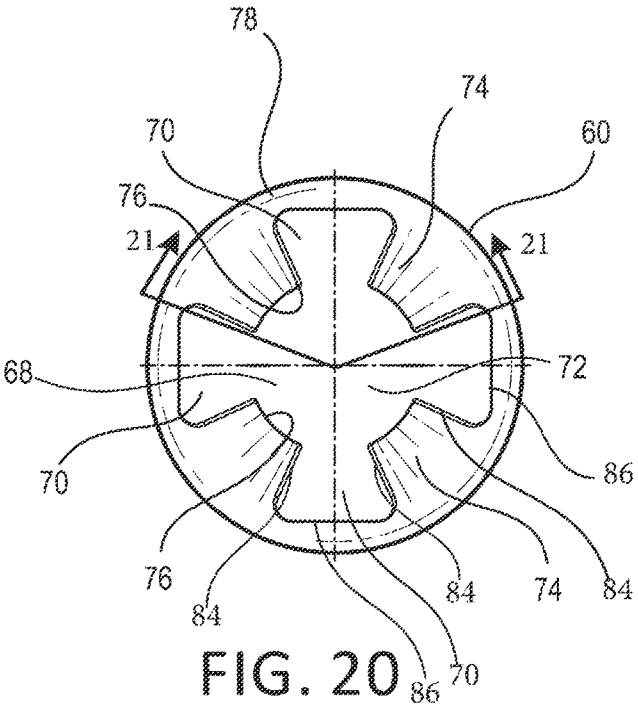
FIG. 20 is a top plan view of the flow distributor of FIG. 19.

As illustrated in FIG. 9, the teeth 74 are preferably configured in a trapezoidal shape formed by opposing sides 84 and the tip 76. In particular, the tip 76 forms an arcuate edge of the teeth 74, such that the arcuate edge forms the innermost circumference of the central opening 72. Additionally, the lobes 70 are preferably configured in a dovetail shape, formed by the opposing sides 84 of the teeth 74 and a lobe base 86.

Referring now to FIGS. 11-21, an alternate embodiment of the present slurry mixer output canister is generally designated 100. Components shared with the canister 10 are marked with identical reference numbers. One main distinction between the two canisters 10, 100 is that the canister housing 16 in the canister 10 has a vertical height of approximately 10 inches±1 inch. However, in the canister 100, a canister housing 102 has a vertical height of approximately 8.5 inches±1 inch. Also, a spiral block 104 has a vertical height of approximately 4.5 inches±1 inch, so that the spiral block has a vertical height taking up approximately 50% of a height of the housing 102.

Another feature of the canister 100 is that since the flow distributor 60 has a vertical height of approximately 3.0 inches±1 inch, there is approximately 1.0 inch remaining in the canister interior 22. As such, a flow chamber 106 (FIG. 13) is defined in the canister interior 22 between the spiral block 104 and the flow distributor 60 has a vertical height of approximately 1.0 inch. It has been found that this arrangement of components within the housing 102 has resulted in enhanced performance, including slurry velocity through the canister 100, in that the flow of slurry through the canister is expedited, and slurry volume is maintained so that unwanted clumping or premature setting is significantly reduced compared to conventional slurry dispensers in wallboard production lines.

While a particular embodiment of the present gypsum slurry mixer output canister has been described herein, it will be appreciated by those skilled in the art that changes and modifications may be made thereto without departing from the invention in its broader aspects and as set forth in the following claims.

The invention claimed is:

1. A gypsum slurry mixer output canister, comprising:
- a canister housing having an upper end, an opposite lower end and defining a canister interior;
- a cover secured to said upper end;
- a slurry inlet in operational relationship to said upper end;
- a spiral block associated with said upper end, and having a helical flow surface depending into said interior;
- a flow distributor secured to said lower end and being in fluid communication with said interior, said flow distributor defining an outlet aperture having a plurality of radially-spaced lobes in fluid communication with a central opening of said outlet aperture, such that said lobes are located within a same plane as said central opening, wherein said lobes are each configured in a dovetail shape; and
- a slurry outlet defined by said lower canister housing end.

2. The canister of claim 1, wherein said upper end has a radially extending flange for accommodating mounting of said cover.

3. The canister of claim 1, wherein said slurry inlet has a non-circular cross-section where said slurry inlet meets said canister housing.

4. The canister of claim 3, wherein said slurry inlet has a rectangular cross-section where said slurry inlet meets said canister housing.

5. The canister of claim 1, wherein said spiral block is secured to an underside of said cover.

6. The canister of claim 1, wherein said spiral block has a vertical inlet wall in fluid communication with said slurry inlet, and forming an end of said helical flow surface.

7. The canister of claim 1, wherein said helical flow surface defines a 360° arc.

8. The canister of claim 1, wherein said spiral block has a vertical height of approximately 4.5 inches, ±1 inch.

9. The canister of claim 1, wherein said canister housing has a vertical height of approximately 8.5 inches±1 inch.

10. The canister of claim 1, wherein said canister housing has a vertical height of approximately 10 inches±1 inch.

11. The canister of claim 1, wherein said flow distributor includes a plurality of radially inwardly projecting teeth defining said plurality of lobes.

12. The canister of claim 11, wherein said teeth each define a radially inwardly tapered internal geometry with upper and lower surfaces that converge to an arcuate edge of said teeth, said arcuate edges forming an innermost circumference of said central opening.

13. The canister of claim 1, wherein said spiral block takes up approximately 50% of a vertical height of said canister housing.

14. A gypsum slurry mixer output canister, comprising:
- a canister housing having an upper end, an opposite lower end and defining a canister interior;
- a cover secured to said upper end;
- a slurry inlet secured to said upper end;
- a spiral block associated with said upper end, and having a helical flow surface depending into said interior;
- a flow distributor secured to said lower end and being in fluid communication with said interior, said flow distributor including a plurality of radially inwardly projecting peripherally spaced teeth which define a plurality of lobe-shaped recesses in communication with a central opening, such that said lobe-shaped recesses are located between adjacent teeth, wherein said spaced teeth are each configured in a trapezoidal shape; and a slurry outlet defined by said lower canister housing end.

15. The canister of claim 14, wherein said vertical height of said canister housing is approximately 8.5 inches, and said vertical height of said spiral block is approximately 4.5 inches.

16. The canister of claim 14, wherein a flow chamber defined between the spiral block and the flow distributor has a vertical height of approximately 1.0 inch.

17. The canister of claim 14, wherein said spaced teeth each define a radially inwardly tapered internal geometry with upper and lower surfaces that converge to an arcuate edge of said teeth, said arcuate edges forming an innermost circumference of said central opening.

18. A gypsum slurry mixer output canister, comprising:

a canister housing having an upper end, an opposite lower end and defining a canister interior;

a cover secured to said upper end;

a slurry inlet secured to said upper end;

a spiral block associated with said upper end, and having a helical flow surface depending into said interior;

a flow distributor secured to said lower end and being in fluid communication with said interior, said flow distributor including a plurality of radially inwardly projecting peripherally spaced teeth which define a plurality of lobe-shaped recesses in communication with a central opening, such that said lobe-shaped recesses are located between adjacent teeth, wherein said spaced teeth each define a radially inwardly tapered internal geometry with upper and lower surfaces which converge to an arcuate edge of said teeth, said arcuate edges forming an innermost circumference of said central opening; and a slurry outlet defined by said lower canister housing end.

19. The canister of claim 18, wherein said spaced teeth are each configured in a trapezoidal shape and said lobes are each configured in a dovetail shape.

20. A gypsum slurry mixer output canister, comprising:

a canister housing having an upper end, an opposite lower end and defining a canister interior;

a cover secured to said upper end;

a slurry inlet secured to said upper end;

a spiral block associated with said upper end, and having a helical flow surface depending into said interior;

a flow distributor secured to said lower end and being in fluid communication with said interior, said flow distributor including a plurality of radially inwardly projecting peripherally spaced teeth which define a plurality of lobe-shaped recesses in communication with a central opening, such that said lobe-shaped recesses are located between adjacent teeth;

a wall of said flow distributor defines a wedge-shaped cross-section, with a tip of said teeth forming a tip of said wedge shape; and a slurry outlet defined by said lower canister housing end.

* * * * *